US009487382B1

(12) United States Patent
Piepmeyer et al.

(10) Patent No.: US 9,487,382 B1
(45) Date of Patent: Nov. 8, 2016

(54) MAGNETIC BOTTLE OPENER

(71) Applicant: Wicked Eye Products, LLC., Huntington Beach, CA (US)

(72) Inventors: Scott Piepmeyer, Huntington Beach, CA (US); Dennis Nelson, Huntington Beach, CA (US)

(73) Assignee: Wicked Eye Products, LLC, Huntington Beach, CA (US)

( * ) Notice: Subject to any disclaimer, the term of this patent is extended or adjusted under 35 U.S.C. 154(b) by 0 days.

(21) Appl. No.: 14/341,673

(22) Filed: Jul. 25, 2014

(51) Int. Cl.
*B67B 7/00* (2006.01)
*B67B 7/16* (2006.01)

(52) U.S. Cl.
CPC ..... *B67B 7/16* (2013.01)

(58) Field of Classification Search
CPC ..... B67B 7/18; B67B 7/44; B67B 7/16
USPC ..... 81/3.25, 3.08, 3.31, 3.09, 3.27, 3.36, 81/3.37, 3.55, 3.07; 269/8, 289 R, 302.1; 232/1 E; 211/85.26
See application file for complete search history.

(56) References Cited

U.S. PATENT DOCUMENTS 2,506,450 A * 5/1950 Grey ..... 81/3.08
2,759,382 A 8/1956 Carp
2,774,264 A 12/1956 Bryant
4,979,323 A * 12/1990 Wenkman et al. ..... 40/746
8,434,388 B2 * 5/2013 Chaffins ..... 81/3.08
2008/0083301 A1 4/2008 Messina

FOREIGN PATENT DOCUMENTS

CN 202529809 U 11/2012
CN 203065134U U 7/2013

OTHER PUBLICATIONS http://dropandcatch.com/products/porter/, Nov. 12, 2013.*
http://imprintplus.com.products/badge-fasteners/, May 15, 2012.*

* cited by examiner

*Primary Examiner* — Lee D Wilson
*Assistant Examiner* — Melanie Alexander
(74) *Attorney, Agent, or Firm* — Patent Law & Venture Group; Gene Scott

(57) ABSTRACT

An apparatus is magnetically mounted onto a metal surface, such as steel, presenting a bottle cap remover and magnetic cap catcher. The apparatus is molded as a one piece body having a plate with a surrounding stiffening flange. The bottle cap remover is fixed to a front surface. Magnets are molded into a rear surface with poles facing rearward, wherein the apparatus is secured by magnetic attraction to the ferromagnetic surface. Bottle caps, once removed, tend to slide on the plate and are captured by magnetic force so as to remain on the plate.

6 Claims, 5 Drawing Sheets

MAGNETIC BOTTLE OPENER

BACKGROUND

This disclosure relates to apparatus for removing bottle caps and for capturing the caps so that they don't litter a floor. This disclosure particularly is directed to a cap remover that is able to be adhered to a mounting surface by magnetic attraction and, since caps are made of a ferromagnetic material, the apparatus is also able to capture removed caps by magnetic attraction. A bottle cap seals the top opening of a bottle. A cap is typically colorfully decorated with the logo of the brand of beverage. Plastic caps are used for plastic bottles, metal with plastic backing is used for glass; the metal is usually steel. A bottle opener is a device that enables the removal of metal bottle caps from bottles. A metal bottle cap is affixed to the rim of the neck of a bottle by being pleated or ruffled around the rim. One type of bottle opener is a special lever inserted beneath the pleated metalwork, which uses a point on the bottle cap as a fulcrum on which to pivot. There are several distinct designs of such bottle openers. Wall mounted openers are typically found behind bars in pubs, whilst hand-tool bottle openers tend to be found and used in domestic environments. Whereas the functional elements of bottle openers, for instance, a tooth or lip to catch the underside of the cap, a fulcrum across which to exert the force that will remove the cap, and usually a lever for mechanical advantage tend to be consistent while sometimes the lever is the bottle itself, their aesthetic design is subject to very great variety, and a great many decorative types are available. A simple opener is fashioned from a piece of metal with a rectangular or rounded opening at one end and a solid handle large enough to be gripped between the thumb and forefingers on the other end. The opening contains a lip that is placed under the edge of the bottle top, pulling it off when upward force is applied to the handle end of the opener. This type of opener is small and durable, so it is frequently mounted on a key ring. The wall mounted opener, such as shown in the illustrations provided herewith, works the same as the lever variation, except that it is attached to a wall, to allow for simpler bottle-opening, which can be done with one hand. The bottle cap typically falls into a bottle cap catcher mounted below the opener, or often it merely falls onto the floor to be cleaned up later. The latter approach is a problem in that littering is a poor example for the young and requires clean-up by someone, usually not the beverage user. Bottle caps under foot have been known to cause falls. The presently described apparatus improves over prior art by enabling the opener to magnetically adhere to a metal surface without scratching it and without installation hardware and also enabling the opener to catch and retain the loosened bottle caps.

BRIEF DESCRIPTION OF DRAWINGS

Like reference symbols in the drawing figures indicate like elements.

DETAILED DESCRIPTION

Figure 1:
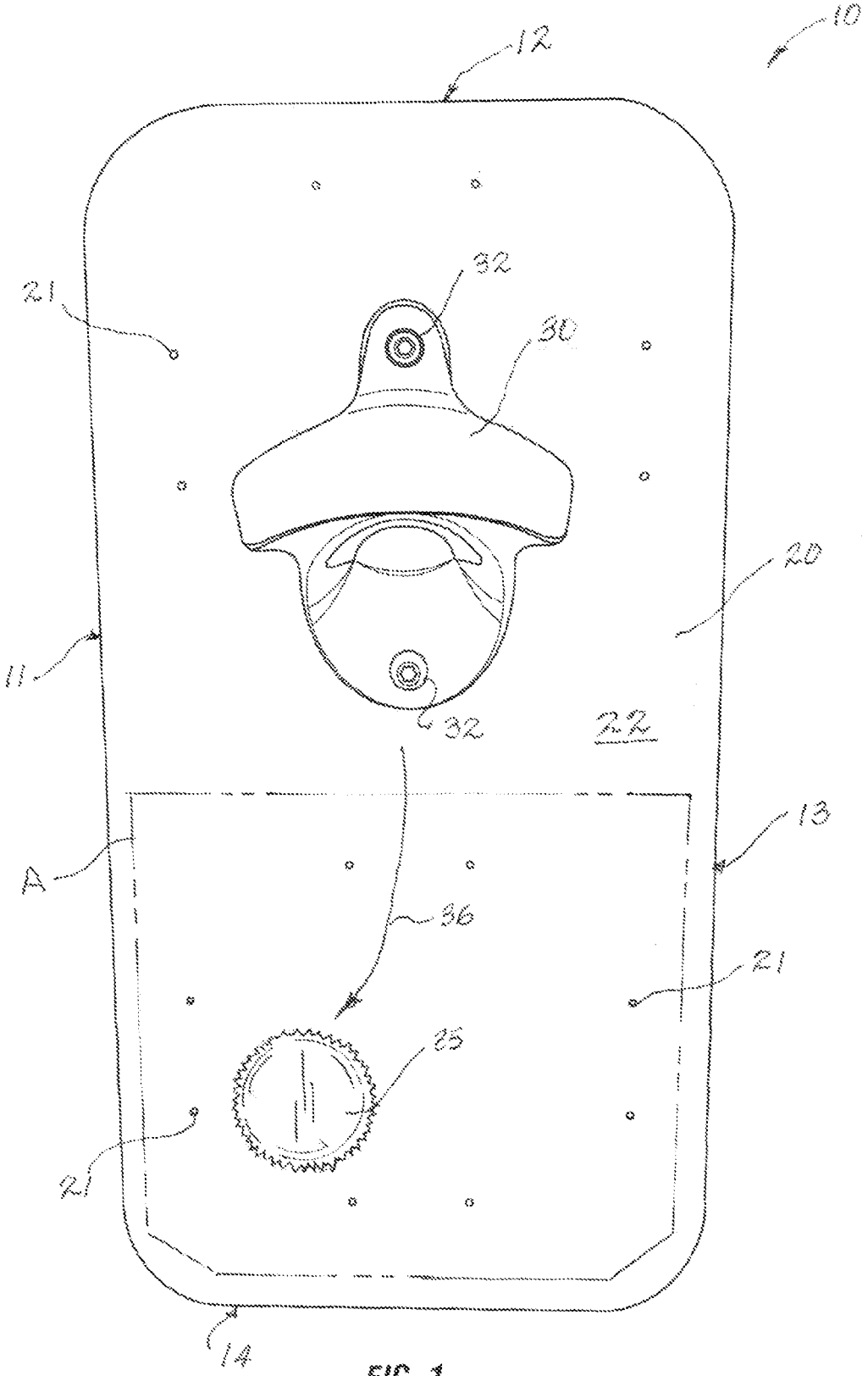
FIG. 1 is an example front elevation view of the apparatus disclosed herein.
Figure 2:
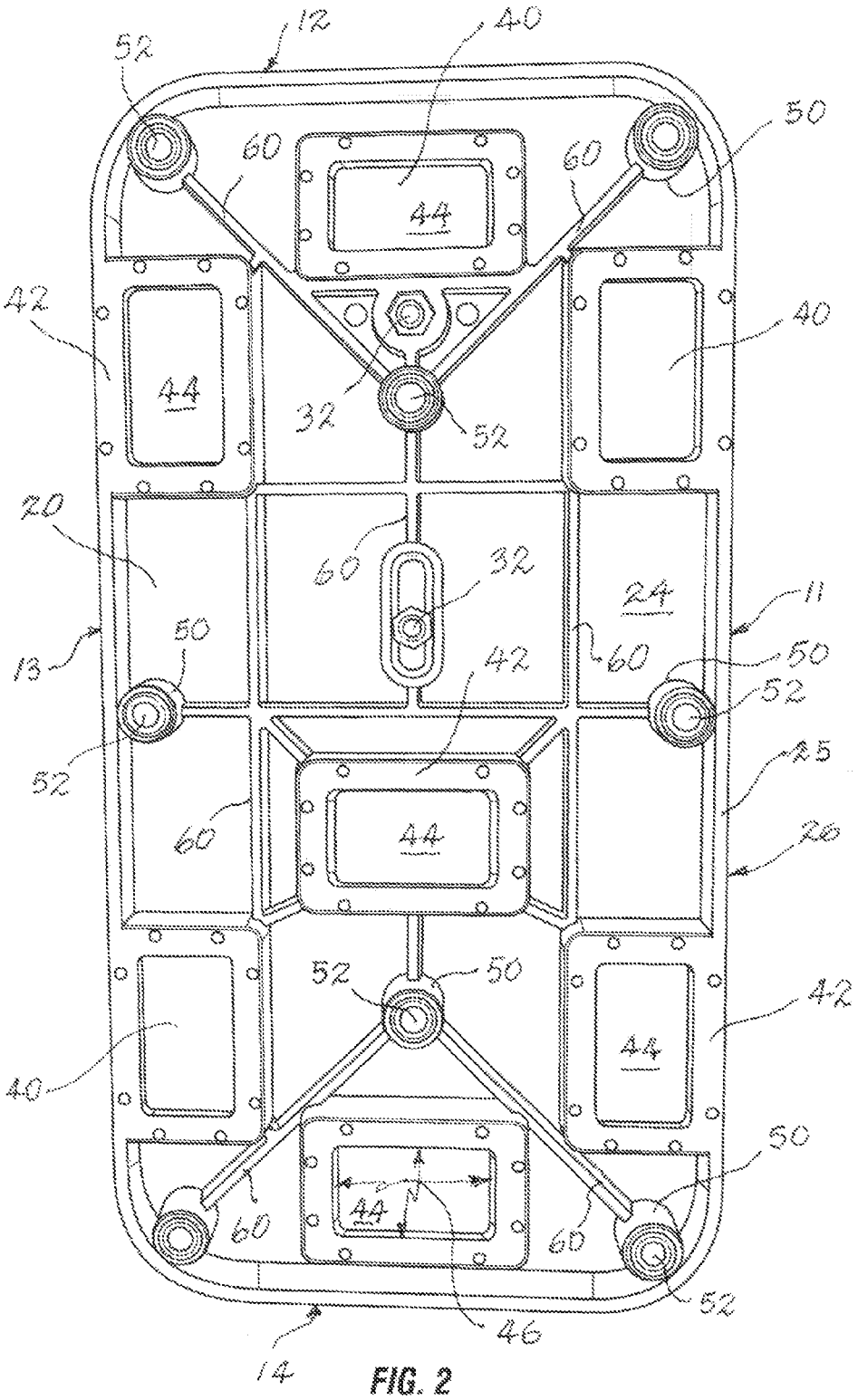
FIG. 2 is a rear elevation view thereof.
Figure 3:
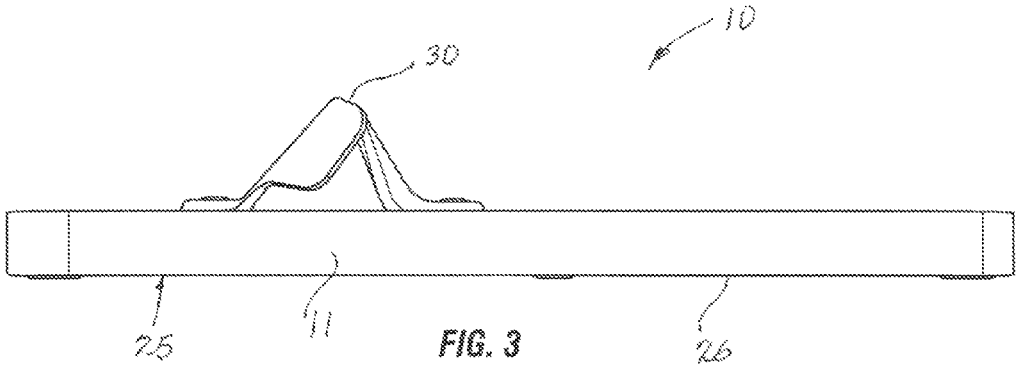
FIG. 3 is a side elevation view thereof.
Figure 4:
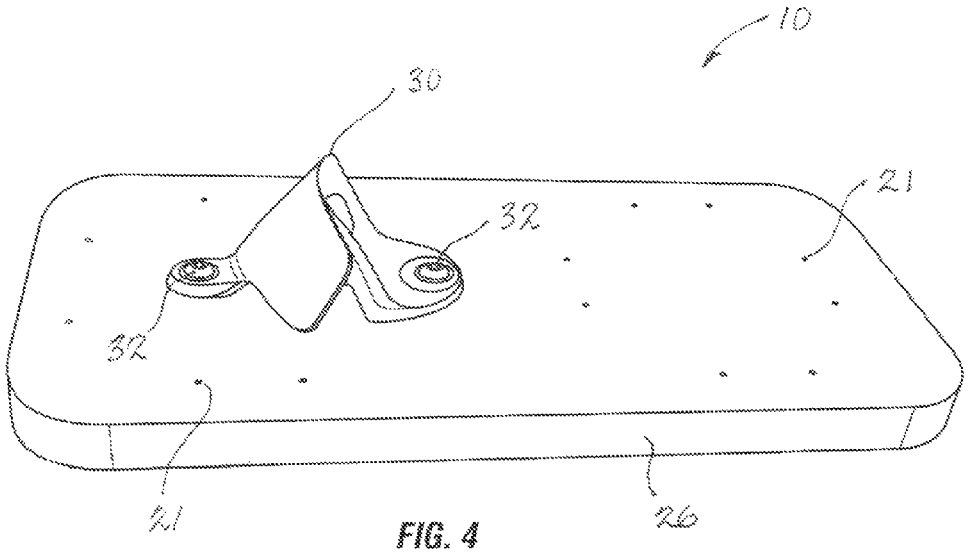
FIG. 4 is a front perspective view thereof.
Figure 5:
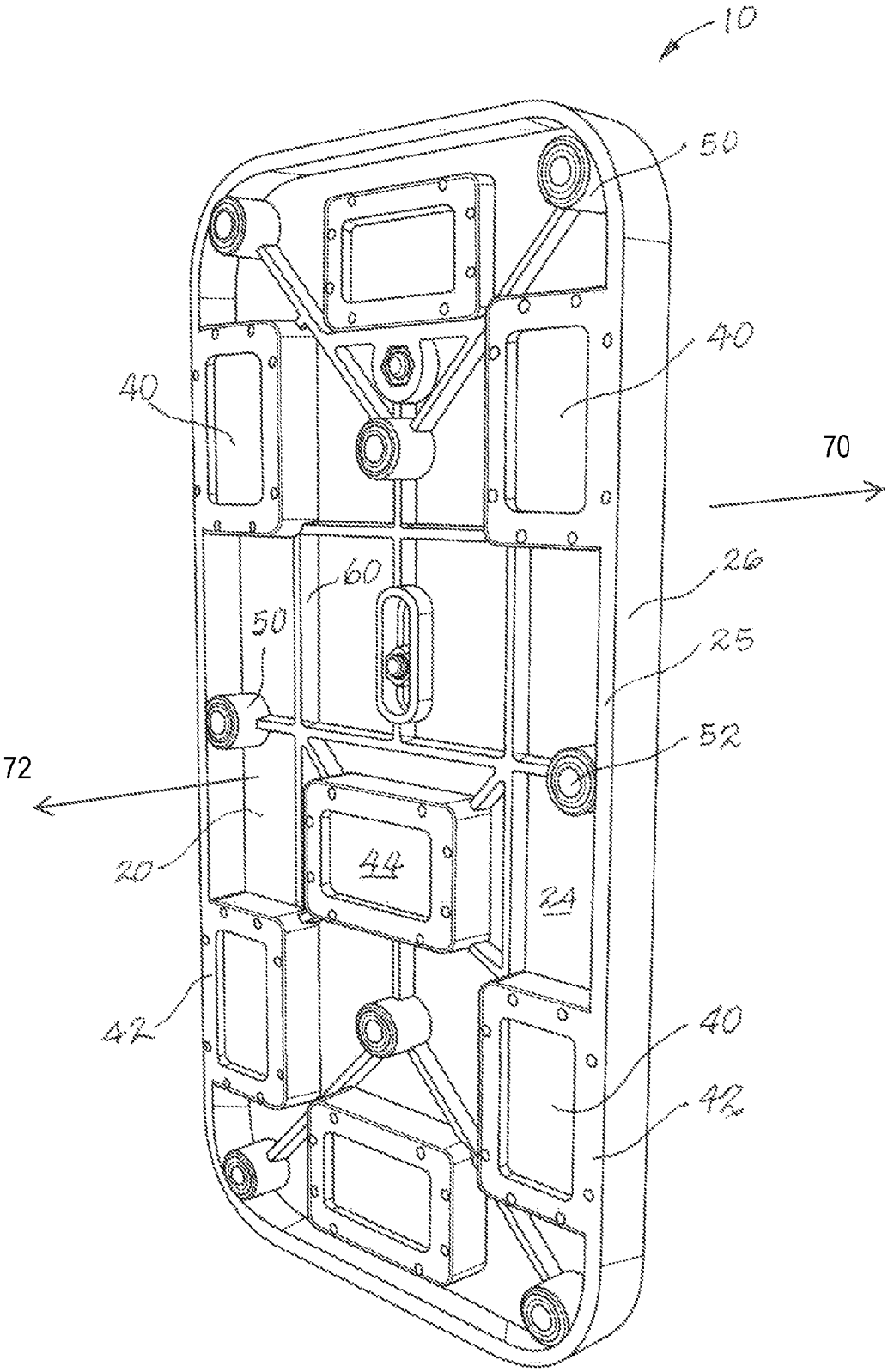
FIG. 5 is a rear perspective view thereof.
Figure 6:
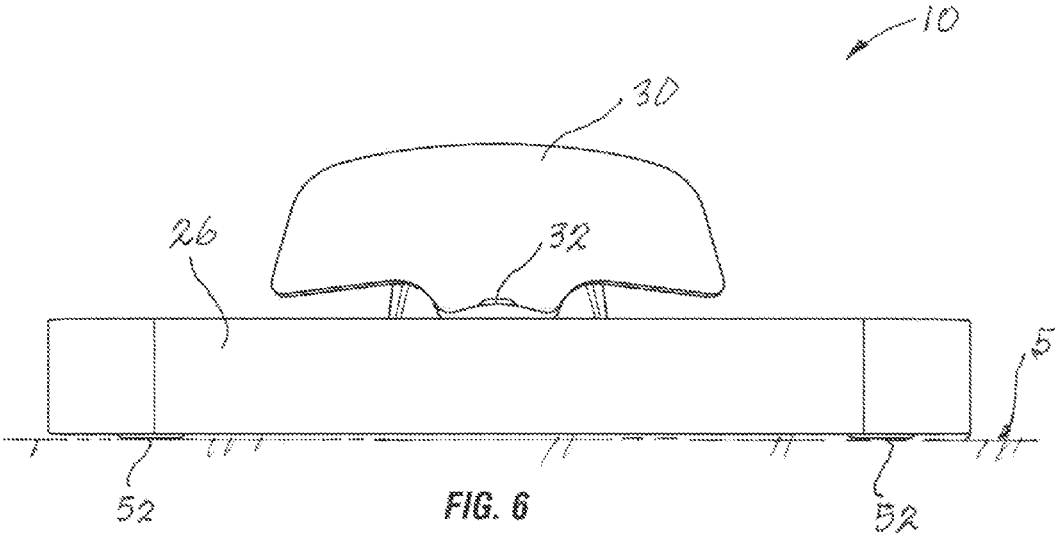
FIG. 6 is a top elevation view thereof showing magnetic mounting on a surface.
Figure 7:
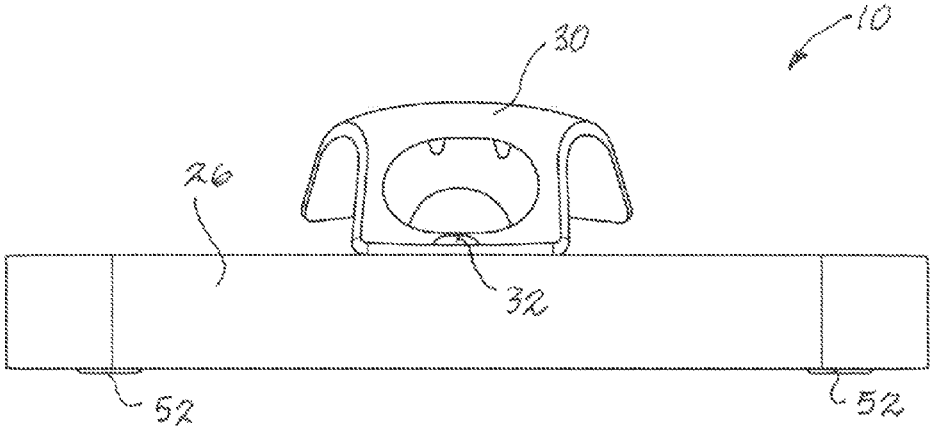
FIG. 7 is a bottom elevation view thereof.

This disclosure describes and illustrates a bottle cap remover with magnetic catcher as a complete apparatus 10 and as illustrated in FIGS. 1-7. Apparatus 10 may have a molded body including a plate 20 with a planar front surface 22 facing in a forward direction as shown by arrow 70 in FIG. 5, a rear surface 24 facing in a rearward direction as shown by arrow 72 in FIG. 5, and a, at least partly surrounding, flange 26, that is flange 26 may fully surround plate 20 or may only partly surround plate 20. Flange 26 may extend away from plate 20, in said rearward direction 72 and terminate at a flange edge 25 wherein no portion of surrounding flange 26 extends forward (in said forward direction 70) of said front surface 22 as best shown in FIG. 5. A common pry-off type bottle cap remover 30 may be attached by fasteners 32, or otherwise, to front surface 22 as best shown in FIGS. 1, 2 and 4. Apparatus 10 may be rectangular in shape as shown or may be any other shape but rectangular is best mode, and flange 26 may define four sides 11, 12, 13, and 14 of plate 20 with two of the sides 11, and 13, longer than the adjoining further two sides 12 and 14. Bottle cap remover 30 may be positioned centrally between the two longer sides 11, 13 and may be positioned asymmetrically relative to the other two sides 12, and 14, that is, closer to side 12 and relatively further from side 14 for reasons to be described. As shown in FIGS. 1 and 4, fourteen ejection holes 21 penetrate plate 20; wherein these holes receive ejection pins for ejecting apparatus 10 from its mold after molding.

As shown in FIG. 2, one or more magnets 40 may be mounted adjacent to rear surface 24 wherein each magnet 40 may be encased within a surround 42 enabling pole surfaces 44 to face away from rear surface 24. Surrounds 42 are molded around magnets 40 encasing them but leaving an open window 46 exposing pole surface 44. Magnets 40 may be arranged as shown in FIG. 2 with three of magnets 40 positioned nearer to side 12 and adjacent to flange 26 and wherein at least one of magnets 40 may be positioned centrally between sides 11 and 13. Four further magnets 40 may be positioned nearer to side 14 as shown. As shown in FIG. 1, when removed by bottle cap remover 30, bottle caps 35 (not a part of the apparatus 10) naturally fall, sliding along front surface 22 toward side 14 as shown by arrow 36 whereby magnetic attraction from magnets 40 may cause caps 35 to magnetically adhere to front surface 22 in positions within zone "A" due to preferentially stronger magnetic fields in this portion of front surface 22.

Apparatus 10 may further comprise plural feet 50 which may be molded integrally with plate 20 and may extend away from rear surface 24. In an embodiment six feet 50 may be positioned adjacent to flange 26 as shown, and in an embodiment, two of feet 50 may be positioned centrally as shown in FIG. 2. Feet 50 may terminate with elastomeric inserts 52 which may extend beyond flange edge 25 for contact with a mounting surface 5 (FIG. 6) so as to prevent apparatus 10 from sliding along the surface 5 (which may be oriented vertically), and also preventing feet 50 from scratching surface 5. As shown in FIGS. 2 and 5 plural ribs 60 may be molded into rear surface 24 as a part of plate 20, wherein ribs 60 may minimize flexing of plate 20 when under load.

Plate 20, flange 26, surrounds 42 feet 50, and ribs 60 may be molded integrally of a resin compound, for instance any polymer that provides rigidity and light weight and does not react to magnetic flux but allows such flux to easily pass through plate 20. Likewise, cap remover 30 is made of a non-ferrous, high strength and rigid material such as aluminum or other metal. In use, plate 20 receives certain forces which it transfers to legs 50. For instance when a bottle cap 35 is inserted into cap remover 30 forces may be delivered to plate 20 in a normal direction. During the movement of extracting cap 35 in cap remover 30 forces are delivered to plate 20 through fasteners 21. These forces must ultimately be absorbed by mounting surface 5 through feet 50 and inserts 52. The elastomeric resilience of inserts 52 helps to smooth-out force impulses and prevent scratching of surface 5. Flange 26 rigidizes plate 20 preventing it from flexing under the forces mentioned above. Although the pole surfaces 44 of magnets 50 may be spaced apart from mounting surface 5 by as much as 0.125 inch, magnetic attraction to between surfaces 44 and 5 enables apparatus 10 to remain stationary on surface 5 during cap removal. The high friction between inserts 52 and surface 5 prevents apparatus 10 from moving on surface 5.

Embodiments of the subject apparatus and method have been described herein. Nevertheless, it will be understood that modifications by those of skill in the art may be made without departing from the spirit and understanding of this disclosure. Accordingly, other embodiments and approaches are within the scope of the following claims.

What is claimed is:

1. An apparatus for capturing bottle caps and defining a forward and a rearward directions relative to the apparatus, said apparatus comprising:

a plate having a planar front surface facing in a forward direction, said plate terminating at a surrounding flange, said surrounding flange extending in a rearward direction wherein no portion of said surrounding flange extends forward of said front surface;

a bottle cap remover attached to said front surface;

a rear surface of said plate, said rear surface being an obverse of said front surface;

magnets secured to said rear surface, said magnets positioned for magnetic interaction with said bottle caps, with said bottle caps in proximity of said front surface;

ribs secured integrally with said rear surface for minimizing flexing of said plate; and feet secured to said rear surface, said feet terminating rearward of said flange in said rearward direction whereby said flange cannot touch a mounting surface magnetically securing said apparatus.

2. The apparatus of claim 1 wherein each of said magnets is encased within a surround, wherein said surround positions a pole surface of said magnet in said rearward direction.

3. The apparatus of claim 2 wherein each said pole surfaces is exposed through an open window of said surround.

4. The apparatus of claim 1 wherein three said magnets are positioned in a triangular arrangement.

5. The apparatus of claim 4 wherein four further of said magnets are positioned in a rectangular arrangement.

6. The apparatus of claim 1 wherein said feet have elastomeric inserts.

* * * * *